United States Patent [19]

Phares

[11] Patent Number: 4,811,769

[45] Date of Patent: Mar. 14, 1989

[54] PURSE INSERT

[76] Inventor: Robert R. Phares, 3355 Claire La. #1415, Jacksonville, Fla. 32217

[21] Appl. No.: 148,368

[22] Filed: Jan. 25, 1988

[51] Int. Cl.[4] ..... A45C 13/02

[52] U.S. Cl. ..... 150/113; 150/104; 150/129; 150/130; 190/110

[58] Field of Search ..... 150/103–105, 150/112, 113, 127, 129, 130; 383/38–40; 190/109, 110

[56] References Cited

U.S. PATENT DOCUMENTS

| | | | |
|---|---|---|---|
| 1,684,232 | 9/1928 | Levit | 383/39 X |
| 2,183,428 | 12/1939 | McNary | 150/113 X |
| 2,210,755 | 8/1940 | Frank | 150/113 |
| 2,467,662 | 4/1949 | Freiberg | 150/129 X |
| 2,529,724 | 11/1950 | Conwiser | 150/113 |
| 2,650,630 | 9/1953 | Mytinger | 150/113 X |
| 3,207,199 | 9/1965 | Erickson | 150/112 |
| 3,256,919 | 6/1966 | Ogletree | 383/7 X |
| 3,958,616 | 5/1976 | Beverstock | 150/113 X |
| 4,641,751 | 2/1987 | Walker | 150/112 X |
| 4,718,524 | 1/1988 | Crumley | 150/113 X |

FOREIGN PATENT DOCUMENTS

| | | | |
|---|---|---|---|
| 1171033 | 7/1984 | Canada | 150/113 |
| 985551 | 7/1951 | France | 150/112 |

*Primary Examiner*—Sue A. Weaver

*Attorney, Agent, or Firm*—Thomas C. Saitta

[57] ABSTRACT

A purse insert capable of retaining a number of articles in separate pockets such that the articles can be transferred from one purse to another by removing and transferring the entire insert. The pockets of the insert are formed of an elastic material such that the pockets retain the individual articles by the elastic nature of the material without requiring closure means.

3 Claims, 3 Drawing Sheets

PURSE INSERT

BACKGROUND OF THE INVENTION

The invention relates to an improved purse insert construction such that a variety of items are retained in elastic pockets of differing size, shape and location in the insert. Furthermore, the entire purse insert including the contained items can be transferred from one purse to another in one easy step.

By their very nature, purses are meant to carry a large number of miscellaneous items, any of which may be needed at a given time. For instance, a non-exhaustive list might be a checkbook, glasses, contact case, calling cards, cigarettes, lighter, pen, pills, lipstick, raincoat, tissues, charge cards, pictures, wallet, key rings, make-up, toothbrush, hair brush, hair spray, soap, chewing gum, candy and a folding umbrella. In purses composed of one or several large receptacle pockets, all these items form an unorganized mass. It is preferable to incorporate a number of particularized compartments or pockets to allow for organization and separation of the items. Many examples of such are known in the art.

It is also very common that different purses will be used by the owner for different occasions. For example, a fancy dinner party requires a different purse than a trip to the grocery store. In this case, the owner must individually remove all of the items from one purse and transfer them to the other. To alleviate this problem, there have been invented various purse inserts. These inserts allow for a one-step transfer of all items from one purse to the other by simply transferring the insert. These purse inserts vary in structure from a pocket having several vertical partitions to inserts that have numerous specialized pockets, snaps and flaps. Examples of these inserts are shown by Ody in U.S. Pat. No. 3,533,459, Holden in U.S. Pat. No. 2,464,312, Smith in U.S. Pat. No. 1,999,669 and Wilson in U.S. Pat. No. 2,893,457.

A major problem with all prior purse inserts, unsolved until this invention, is that the individual pockets and compartments do not by themselves restrain and therefore retain the article or articles contained therein. The various prior art patents attempt to solve this problem by utilizing zippers, snaps or other fastening means to physically close the pocket openings. This solution requires additional material, hardware and labor in the construction of the purse insert and results in a bulkier, more complicated insert requiring physical manipulation to get to the various items. Furthermore, unless every one of the pockets and compartments are equipped with these closure means and every closure is secured, items will be lost from the open pockets should the purse or insert be inverted during use or transfer of the insert.

BRIEF DESCRIPTION OF THE INVENTION

This invention solves the above problem in a simple, economical way which allows for a maximum number of individual compartments without additional material or hardware. This invention solves the problem by forming the pockets from material or fabric having elastic properties. In this manner, an article is inserted in an individual pocket by stretching the pocket fabric itself. The elastic nature of the pocket, in wanting to return to its original, unstretched dimensions, acts to secure each article in the pocket. Upon removal of the article, the fabric resumes it original dimensions and is in no way intrusive or disruptive of the organized contents. Even inverting the insert results in no loss of articles from the pockets. No zippers, snaps or fasteners are required. Construction of the pockets can be accomplished by normal sewing operations.

It is an object of this invention to provide an insert for purses, the insert able to be transferred from one purse to another without separate removal of the articles contained in the insert.

It is a further object of this invention to provide such an insert which incorporates numerous pockets or compartments designed to contain individual articles.

It is a further object of this invention to provide such an insert where the individual pockets or compartments retain the articles contained therein without requiring fastening means.

It is a further object of this invention to provide such an insert where the material composing the pockets or compartments is elastic in nature such that the material itself retains articles contained therein.

DETAILED DESCRIPTION OF INVENTION

Figure 1:
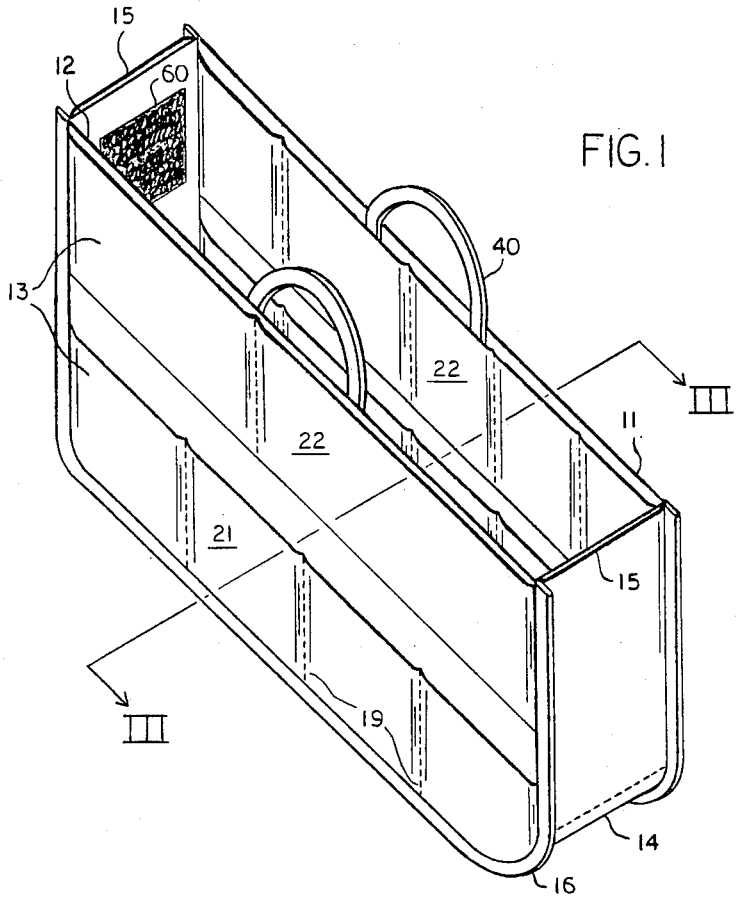
FIG. 1 is a perspective view of the invention showing the relative positioning of the pockets and other components.

In this description, reference will be made to the embodiment as illustrated in the drawings. It is to be understood that the actual size, dimensions and relative positioning of the various components of the invention will vary according to the size, shape and functions required in the individual usage. A large purse can hold a large purse insert, which allows room for more pockets. A small purse will require a small insert and, correspondingly, less pockets may be included because of the size constraints.

Figure 2:
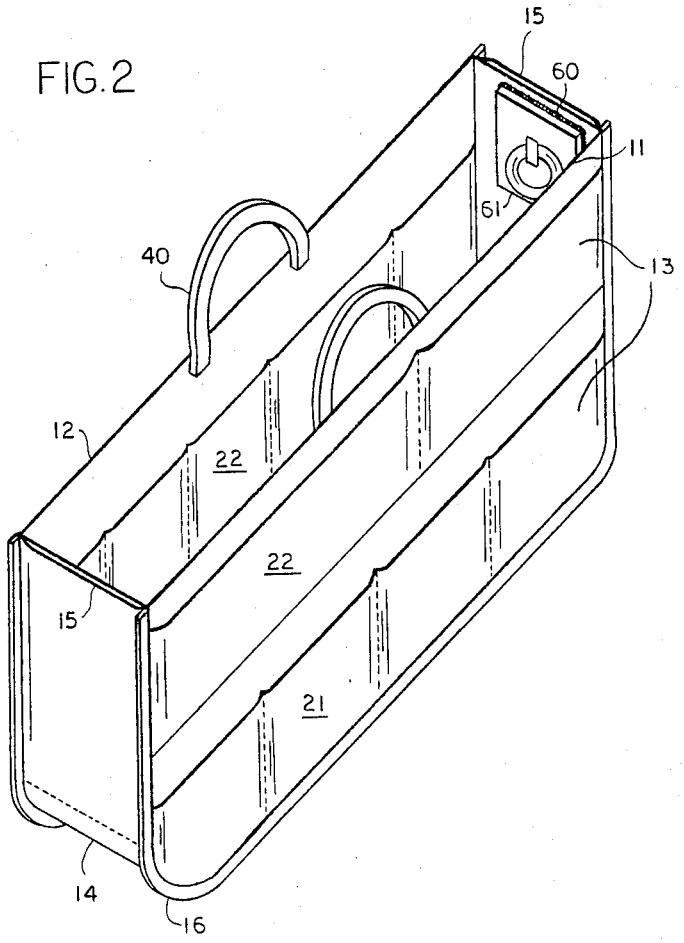
FIG. 2 is a perspective view of the opposite side of the invention.

As shown in FIG. 1 and FIG. 2, the invention is in the general shape of a three dimensional, rectangular container having a relatively short width in comparison to its height and length. In describing the invention, the vertical direction will correspond to the position where the opening is at the top, which is the normal position of the invention. The bottom corners are rounded for ease of insertion into the purse itself. Two relatively parallel, vertical walls 11 and 12 form the principal structure of the invention. These walls are constructed from a flexible material 17 having the properties of durability, washability and aesthetic appeal. For example, common fabrics such as cotton, polyester, nylon, etc., may be used. This wall material 17 should be flexible but not elastic, since this material forms the structure of the insert and gives the insert its shape, while also being the material onto which the various elastic pockets 13 are attached. The inner component of walls 11 and 12 is a stiff, planar sheet 50 of plastic material or the like, such as high impact styrene, which is the backbone of the wall structure. This sheet 50 is cut to the desired shape of the principal walls. The elastic pockets 13 are made from any material or synthetic fabric having the properties of durability, washability and aesthetic appeal, plus the additional property of being capable of being stretched beyond its normal dimensions in the relaxed state, in one or more directions, with the ability and desire to return to the relaxed state. A number of woven fabrics are known in the art which meet these requirements. The elastic pockets 13 are attached by sewing to both the inside and outside of walls 11 and 12. The walls 11 and 12 are connected to each other along the bottom and vertical edges by a strip of elastic material 14. This elastic strip 14 forms the bottom and side walls of the invention, and allows the insert to be expanded in width as required to carry larger items. Additional elastic sections are sewn to each vertical side of this elastic strip 14 to form vertical side pockets 15. Another elastic section is sewn on the outside bottom of elastic strip 14 to form an underside pocket 18. A cover bias or hem 16 envelopes the free edges along the bottom and sides of the principal walls 11 and 12, thus preventing separation and wear on the edges.

Figure 3:
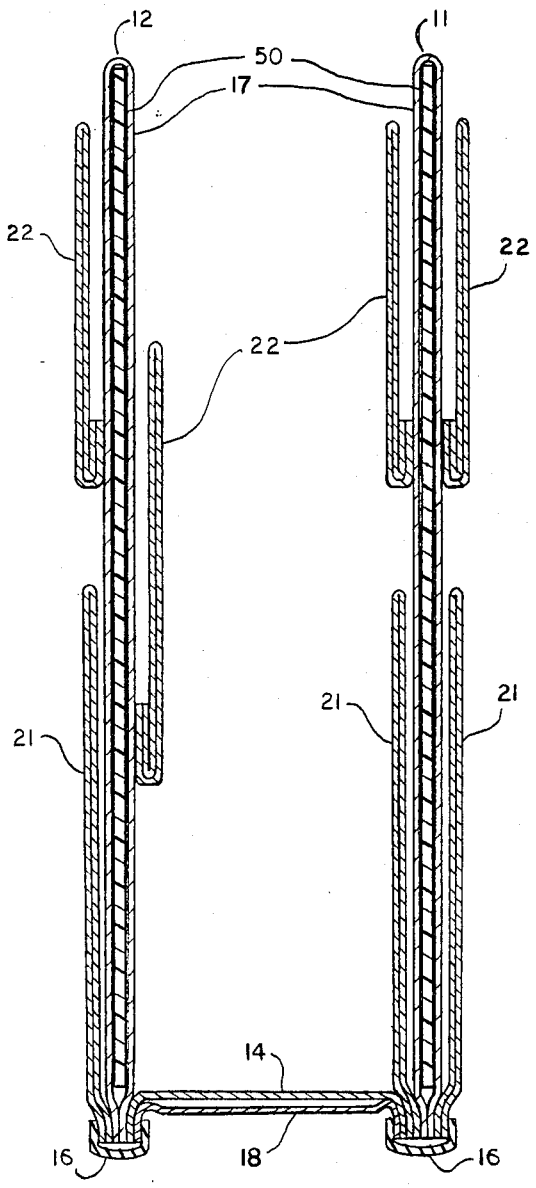
FIG. 3 is a cross-sectional slice taken along line III—III of FIG. 1, showing the construction of the invention.

Construction of the invention is better seen with reference to FIG. 3. This cross-sectional slice shows the positioning and manner of attachment of various components. Each vertical wall 11 and 12 has an inner sheet 50 surrounded by the flexible, non-elastic, wall material 17. Preferably, for ease of construction, wall material 17 is slightly over twice the height of inner sheet 50 so that a fold will form the top edge and stitching will only be required on the three other edges. The two vertical walls 11 and 12 are attached by elastic strip 14, sewn along each of the three edges of wall material 17 requiring stitching. This forms the bottom and side walls. Each elastic pocket 13 is made of a double layer of elastic material, folded so that the upper edge of each pocket 13 is formed by the fold and no stitching is required. The pockets 13 are attached to the wall material 17 in two different ways, depending on the location of the pockets 13. Bottom pockets 21 are attached along the bottom edge of the vertical walls 11 and 12 by stitching to the adjacent side of wall material 17. Upper pockets 22 are attached by folding under the lower portion of the elastic material and stitching to wall material 17 along a horizontal line. When the pocket is stitched vertically, the stitching is hidden by the elastic material itself. Vertical stitching 19 creates the individual pockets 13. The cover hem 16 is sewn around the edges of wall material 17, the edges of the bottom pockets 21, and the edge of elastic strip 14, one cover hem 16 for each vertical wall 11 and 12, thereby unifying the structure and presenting a finished appearance.

Additional features incorporated in the invention are seen with reference again to FIG. 1 and FIG. 2. Removal means, such as finger loops 40, are attached to the wall material 17 along the top of each vertical wall 11 and 12. These loops 40 allow easy extraction of the purse insert from the purse. Further, loop and hook fasteners 60 or other common fasteners can be used to hold keyrings 61 at either or both ends of the invention.

The above description having been defined with some particularity, it is to be expected that those skilled in the art will have suggested to them obvious equivalents and substitutions. Accordingly, the full scope of the invention is to be as set forth in the following claims.

I claim:

1. A purse insert comprising:

A. two substantially parallel, principal walls formed from a relatively stiff, yet flexible, plastic sheet, substantially rectangular in shape, covered on both sides by a flexible, non-elastic fabric material;

B. a strip of elastic material connecting the two principal walls along their bottom and vertical edges, thereby defining a central area open only at the top, where the principal walls can be separated to accommodate large items by stretching the elastic connecting material; and C. a plurality of pockets formed from a material having elastic properties, where the pockets are formed by attaching one or more horizontal strips of double-layered elastic material to the flexible, non-elastic fabric material of the principal walls and further vertically stitching the horizontal elastic material to form individual pockets open only at the top.

2. The purse insert of claim 1, wherein said one or more horizontal strips include strips creating pockets along the bottom edges of the principal walls which are attached to the flexible, non-elastic fabric by stitching along the edges of the principal walls; and strips creating pockets on the upper portions of the principal walls which are attached to the flexible, non-elastic fabric by stitching an inside flap of the elastic material to the principal wall, then turning up the elastic material to form the pockets.

3. The purse insert of claim 1, further comprising single layers of elastic material attached to the strip of elastic material connecting the principal walls to form additional pockets.

* * * * *